US012187508B2

(12) United States Patent
McDonald et al.

(10) Patent No.: US 12,187,508 B2
(45) Date of Patent: Jan. 7, 2025

(54) CHILD RESISTANT CAP FOR FLUID DISPENSING CONTAINERS

(71) Applicant: Jetty Marketing, LLC, Oakland, CA (US)

(72) Inventors: Michael James McDonald, Lafayette, CA (US); Robert William Ferguson, Oakland, CA (US); Ron Abraham Gershoni, Oakland, CA (US); Nathan Charles Ferguson, Oakland, CA (US); Katherine Alexander McWilliams, Carlsbad, CA (US); Ryan Artale, Crested Butte, CO (US)

(73) Assignee: Jetty Marketing, LLC, Oakland, CA (US)

( * ) Notice: Subject to any disclaimer, the term of this patent is extended or adjusted under 35 U.S.C. 154(b) by 215 days.

(21) Appl. No.: 17/819,722

(22) Filed: Aug. 15, 2022

(65) Prior Publication Data

US 2023/0047468 A1 Feb. 16, 2023

Related U.S. Application Data

(60) Provisional application No. 63/232,801, filed on Aug. 13, 2021.

(51) Int. Cl.

| | |
|---|---|
| ***B65D 50/04*** | (2006.01) |
| ***A24F 7/00*** | (2006.01) |
| ***A24F 40/49*** | (2020.01) |

(52) U.S. Cl.

CPC ..... *B65D 50/046* (2013.01); *A24F 7/00* (2013.01); *A24F 40/49* (2020.01)

(58) Field of Classification Search

USPC ..... 222/421, 153.1; 215/222, 206, 201

See application file for complete search history.

(56) References Cited

U.S. PATENT DOCUMENTS 3,669,296 A * 6/1972 Drew ..... B65D 55/145 215/206

3,782,604 A 1/1974 Kessler (Continued)

FOREIGN PATENT DOCUMENTS

| | | | |
|---|---|---|---|
| CA | 3058704 A1 * | 9/2020 | ..... B65D 50/046 |
| CA | 3075587 A1 * | 9/2020 | ..... A24F 47/00 |
| EP | 3310684 B1 | 12/2020 | |

OTHER PUBLICATIONS

E-Cigarette Use Among Youth and Young Adults: A Report of the Surgeon General; U.S. Department of Health and Human Services; 2016 298 pages.

(Continued)

*Primary Examiner* — Paul R Durand
*Assistant Examiner* — Michael J. Melaragno
(74) *Attorney, Agent, or Firm* — Kubota & Basol LLP

(57) ABSTRACT

The present invention pertains to a child resistant cap configured to seal a container while keeping the contents secure therein. The child resistant cap disclosed herein is intended to allow access to those instructed on the manner of removal to allow the dispensing of a container's contents while providing suitable resistance to the efforts of children to gain access. The manner of removal requires multiple steps intended to resist the efforts of children in accordance with current poison prevention packaging regulations.

14 Claims, 6 Drawing Sheets

(56) References Cited

U.S. PATENT DOCUMENTS 4,334,638 A * 6/1982 Stock ..... B65D 17/06 222/545
4,408,699 A * 10/1983 Stock ..... B65D 17/06 422/930
4,413,753 A * 11/1983 Stock ..... B65D 41/18 222/149
4,705,181 A 11/1987 Burke et al.
4,979,840 A * 12/1990 Madaus ..... B43K 5/10 401/202
5,484,070 A 1/1996 Graham
6,450,352 B1 * 9/2002 DeJonge ..... B65D 50/041 215/208
6,758,358 B1 * 7/2004 Bloom ..... B65D 50/061 215/206
6,926,174 B1 * 8/2005 Heldt ..... B05B 11/0027 222/153.1
7,017,782 B2 * 3/2006 Harrold ..... B65D 50/04 222/153.1
7,040,497 B2 * 5/2006 Weiler ..... B65D 1/095 215/217
7,225,949 B2 * 6/2007 Kubo ..... B65D 51/1616 222/189.09
8,002,149 B2 * 8/2011 Leonard ..... B65D 50/046 222/153.1
8,205,762 B2 * 6/2012 Carroll ..... B65D 50/04 222/521
8,333,288 B2 * 12/2012 Miller ..... B65D 50/046 222/523
10,220,989 B2 3/2019 Painchaud et al.
10,329,075 B2 * 6/2019 Gershoni ..... A61J 1/00
11,416,515 B2 * 8/2022 Krietzman ..... G06F 16/27
11,971,904 B2 * 4/2024 Krietzman ..... A24F 40/49
2001/0019033 A1 * 9/2001 Montgomery ..... B65D 41/065 215/222
2005/0072792 A1 * 4/2005 Harrold ..... B65D 47/126 222/48
2005/0230341 A1 * 10/2005 Dong ..... B65D 41/0414 215/222
2008/0035597 A1 * 2/2008 Leonard ..... B65D 50/046 215/211
2012/0175336 A1 * 7/2012 Miller ..... B65D 3/04 215/216
2015/0102123 A1 * 4/2015 Nichols ..... A61M 15/08 239/34
2016/0130050 A1 * 5/2016 St. Clair ..... B65D 51/242 215/206
2016/0213857 A1 * 7/2016 Plumptre ..... A61M 5/31545
2017/0210520 A1 * 7/2017 Woodward ..... B65D 47/18
2018/0327173 A1 * 11/2018 Gershoni ..... A61J 1/00
2019/0127119 A1 5/2019 Kokubo
2020/0046030 A1 * 2/2020 Krietzman ..... G06K 19/07758
2020/0290791 A1 * 9/2020 Jones ..... A24F 47/00
2020/0360239 A1 * 11/2020 Campos ..... A61J 7/0053
2020/0369442 A1 11/2020 Aboabdo
2022/0358137 A1 * 11/2022 Krietzman ..... A24F 40/53
2023/0047468 A1 * 2/2023 McDonald ..... A24F 7/00
2023/0048464 A1 * 2/2023 McDonald ..... B65D 83/0011

OTHER PUBLICATIONS

Emoto et al; Accidental Acute Cannabis Intoxication Presenting as Seizure in Pediatrics Patients; Kans J Med. 2020; 13: 129-130.; Published online May 21, 2020; https://www.ncbi.nlm.nih.gov/pubmed/?term=Emoto%20J%5BAuthor%5D&cauthor=true&cauthor_uid=32499866.

Wang et al.; Poisoning exposure cases involving e-cigarettes and e-liquid in the United States, 2010-2018; Clinical Toxicology vol. 58, 2020—Issue 6; 488-494; Published online Sep. 9, 2019; https://www.ncbi.nlm.nih.gov/pmc/articles/PMC7061080/.

* cited by examiner

CHILD RESISTANT CAP FOR FLUID DISPENSING CONTAINERS

CROSS REFERENCE TO RELATED APPLICATIONS

This application claims the benefit of U.S. Provisional Patent Application 63/232,801 entitled "CHILD RESISTANT CAP FOR FLUID DISPENSING CONTAINERS" filed on Aug. 13, 2021, the entire contents of which are incorporated herein by reference in its entirety for all purposes.

FIELD OF THE INVENTION

The present invention pertains to a child resistant cap configured to seal a container while keeping the contents of the container therein. Further, the child resistant cap disclosed herein is intended to allow access to those instructed on the manner of removal to allow the dispensing of a container's contents while providing suitable resistance to the efforts of children to gain access.

BACKGROUND OF THE INVENTION

In recent years, the use of fluids containing active ingredients extracted from tobacco, cannabis, and other controlled substances has rapidly increased. The use of such fluids and compounds are dispensed from a variety of containers such as vaporizing inhaling devices (commonly referred to as "vape pens"), fluid dispensers, ingestion devices, and the like. Due to the increased use of such containers and increased portability thereof, there has been a marked increase in accidental poisonings of children 5 and younger through the accidental ingestion of tobacco, cannabis, and other compounds consumed by adults which are otherwise found to be toxic to young children.

Many cannabis and tobacco dispensing devices provide the ability to ingest doses of cannabis or tobacco appropriate for an adult through the breathing in while activating the device. Furthermore, some containers are intended for the refilling of dispensing devices. Dispensing devices are commonly the size of a permanent marker or smaller, while refilling containers are sometimes are smaller than a common AAA battery. Due to the small sizes of these objects, they pose a high risk of exploratory ingestion, chewing, simple curiosities of a toddler. The adverse effects of cannabis intoxication on toddlers have been observed as presenting with ataxia, lethargy, tremors, coma, and seizures. While little is known about the pharmacokinetics of cannabis in children, neurological impairment is the main manifestation of cannabis intoxication in children under 3-years of age.

The toxicity of tobacco has been long studied in adolescents and children. The problem surrounding accidental injection of e-cigarettes and refillable cartridges has been well documented. Between the years of 2010-2018, nearly 65% of all documented e-cigarette exposure case victims are children under the age of five for a total of 11,250 children. While this figure represents all types of e-cigarette exposure, the most common cases were though ingestion (76.7%). Among children younger than the age five, the most common clinical effects were vomiting, coughing, or choking, and lethargy.

It is apparent that common-sense steps of prevention do not always prevent children's access to dispensers and containers which contain tobacco or cannabis from children.

Therefore, there is an intrinsic need for child-resistant access devices which limit the access and potential for ingestion of such chemicals by young children.

SUMMARY OF THE INVENTION

The present invention as disclosed herein surrounds a child resistant cap configured to prevent access to fluids contained therein by children to chemical compounds such as cannabis-based or tobacco-based compounds.

It is an aspect of the present invention to provide a child-proof cap for a fluid dispenser in accordance with 16 CFR § 1700 Poison Prevention Packaging regulations while maintaining a form factor in accordance with the intended purpose and portability of the fluid dispensing device.

It is an aspect of the present invention to provide a child-proof cap which provides at least one sealing element to prevent unintentional dispensing from a dispenser tip when the cap is in place.

Many existing child resistant applications rely upon the action of pushing axially inward on a cap followed by a twisting motion to disconnect the cap from a container wherein the cap and container are interconnected by screw threads, often requiring 360-degrees of more of rotation for disconnection.

It is an aspect of the present invention to provide a child resistant cap which requires 180-degrees rotation or less to orient the cap in a manner which it can be removed from the container or dispenser.

In certain embodiments comprising a child resistant cap, the child resistant cap is configured to interconnect with a dispensing tip of a container wherein the cap comprises at least one key directed radially inward from the cap. The keys are configured to interconnect with a groove around a circumference of the dispensing tip wherein when the keys are engaged with the groove of the dispensing tip, the child resistant cap is restricted from being axially removed from the dispenser.

In certain embodiments, a child resistant cap comprising keys which are configured to interface with a keyway of a dispensing tip, wherein the child resistant cap is not removable from the dispensing tip unless the keys are aligned with the keyway of the dispensing tip. Certain embodiments comprise a child resistant cap with a single keyway, while alternate embodiments comprise multiple keyways which are required to be aligned with multiple keyways, while further embodiments still require multiple keys to be aligned with a singular keyway.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
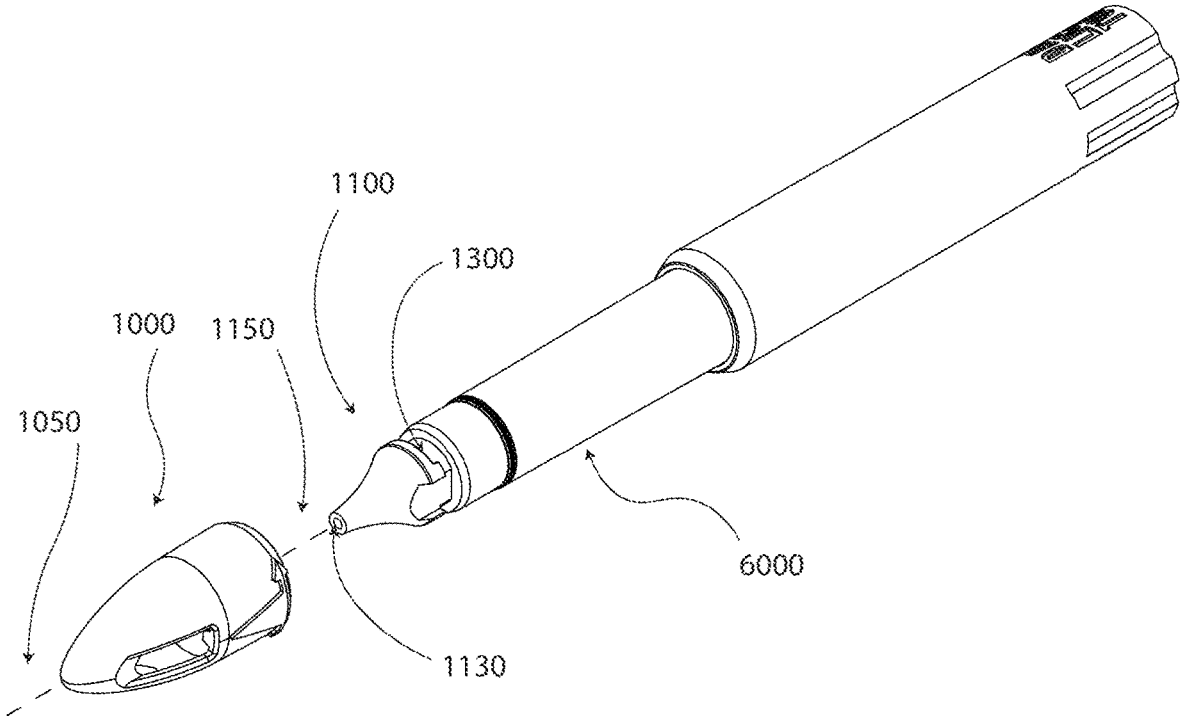
FIG. 1A—An exploded perspective view of certain embodiments comprising a child resistant cap configured to interconnect with a dispensing tip FIG. 1B—An exploded perspective view of certain embodiments comprising a child resistant cap configured to interconnect with a dispensing tip FIG. 2A—A front view of certain embodiments of a dispensing tip FIG. 2B—A section view of the dispensing tip as shown in FIG. 2A FIG. 3A—A side view of certain embodiments of a child resistant cap FIG. 3B—A bottom view of the child resistant cap as shown in FIG. 3A FIG. 3C—A section view of the child resistant cap as shown in FIG. 3A FIG. 4A—A front view of certain embodiments of a child resistant cap assembled with a dispensing tip FIG. 4B—A section view of the child resistant cap and dispensing tip as shown in FIG. 4A in a locked configuration FIG. 4C—A section view of the child resistant cap and dispensing tip as shown in FIG. 4A in an unlocked configuration FIG. 5A—An exploded view of child resistant cap configured to interconnect with a dispensing tip FIG. 5B—An exploded section view of the child resistant cap and dispensing tip as shown in FIG. 5A FIG. 5C—An assembled section view of the child resistant cap and dispensing tip as shown in FIG. 5A FIG. 5D—A section view of the child resistant cap as shown in FIG. 5A FIG. 6A—A side view of an insert of certain embodiments FIG. 6B—A section view of the insert as shown in FIG. 6A FIG. 7—An exploded perspective view of certain embodiments comprising a child resistant cap configured to interconnect with a dispensing tip FIG. 8A—A front view of certain embodiments of a child resistant cap FIG. 8B—A bottom view of the child resistant cap as shown in FIG. 8A FIG. 8C—A side view of the child resistant cap as shown in FIG. 8A FIG. 8D—A section view of the child resistant cap as shown in FIG. 8C
Figure 1B:
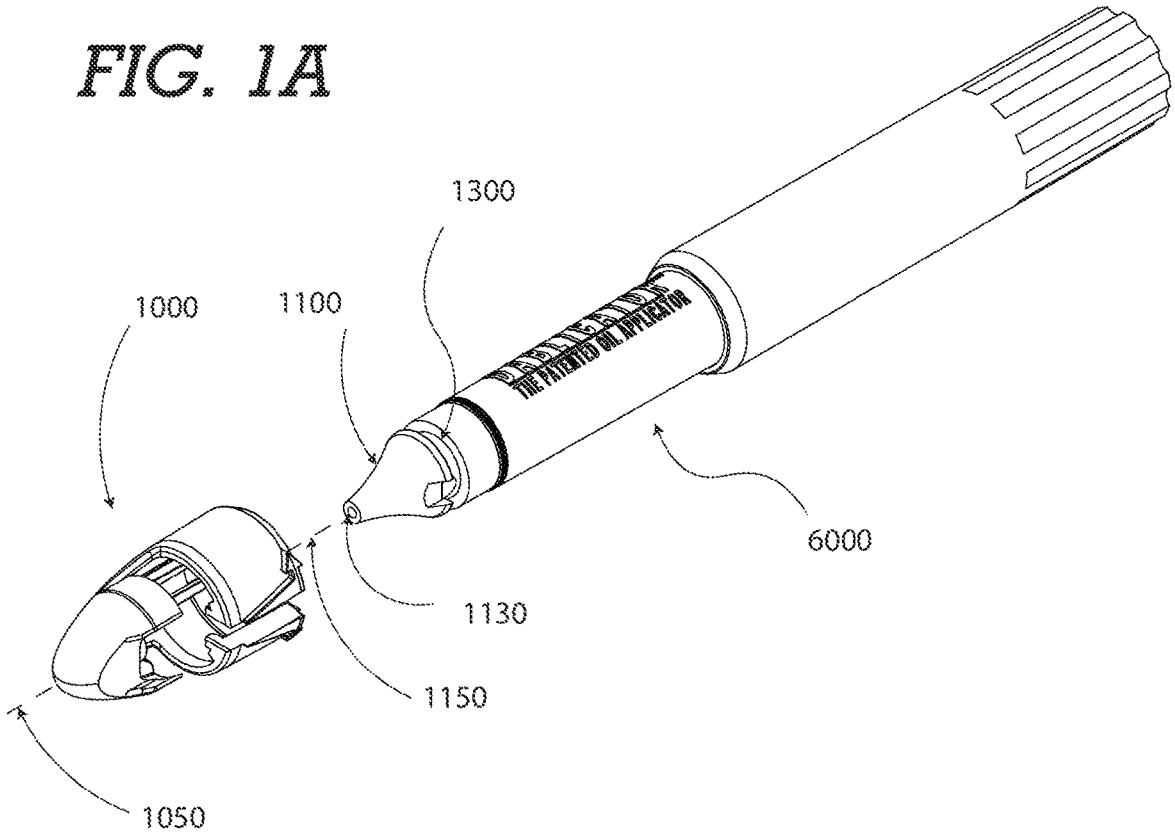
Figure 2A:
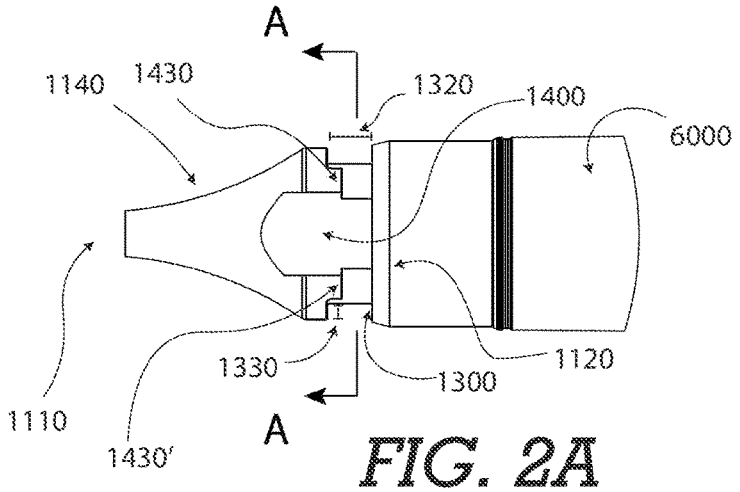
Figure 2B:
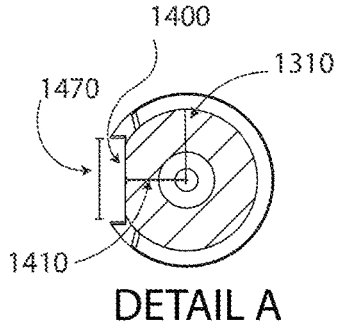
Figure 3A:
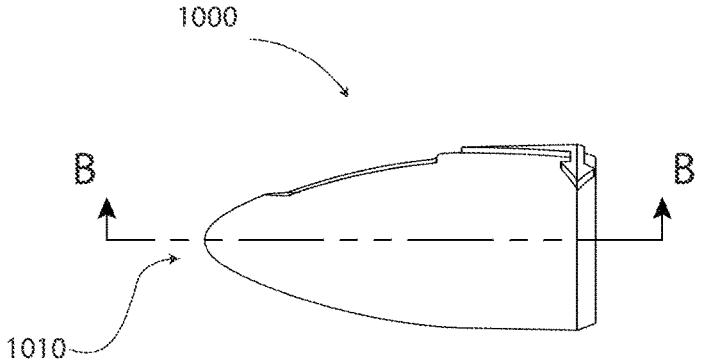
Figure 3B:
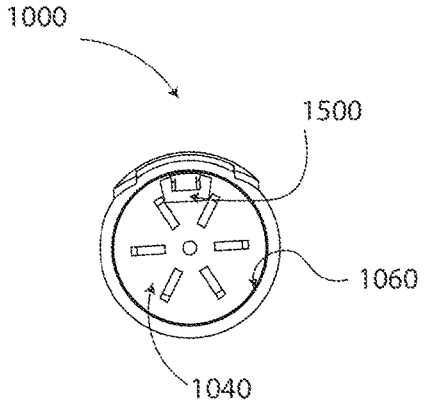
Figure 3C:
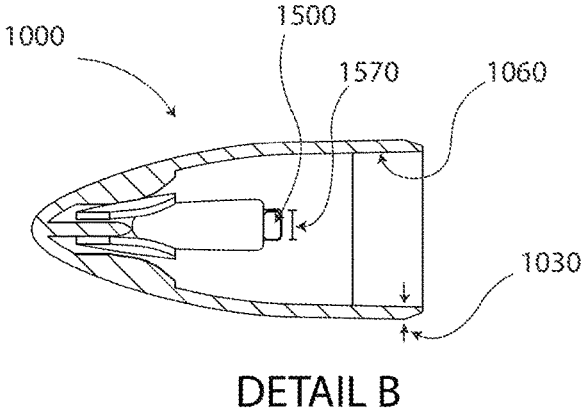

Certain embodiments of the present invention, such as those shown in FIG. 1A-FIG. 1B, comprises a child-resistant cap 1000 configured to interface with a dispensing tip 1100 of a container wherein the removal of the child-resistant cap meets the requirements of 16 CFR § 1700 Poison Prevention Packaging regulations. A cap 1000 is configured to interconnect with a dispensing tip 1100 and prevent the unauthorized removal of the cap 1000 from the dispensing tip 1100 without performing a specific series of steps. The dispensing top 1100 is configured to be interconnected with a chamber 6000 configured to contain a fluid for dispensing.

In certain embodiments, as shown for example in FIG. 1A-FIG. 2B, a dispensing tip comprises a longitudinal axis 1150 which coincides with a dispensing aperture 1130 of the dispensing tip. The dispensing aperture 1130 is located at a first end 1110 of the dispensing tip and allows the passage of fluid therethrough. The dispensing tip further comprises a circumferential groove 1300 which is offset from the first end 1110 of the dispensing tip toward the second end 1120 of the dispensing tip. The circumferential groove 1300 comprises a width 1320, and a depth 1330. The second end 1120 of the dispensing tip is configured to interconnect with a chamber 6000 configured to contain a fluid for dispensing. The circumferential groove 1300 of certain embodiments is offset from the first end 1110 just past a tapered portion 1140 of the dispensing tip, however embodiments are not limited thereto.

Certain embodiments, as shown for instance in FIG. 1A and FIG. 2A-FIG. 4C, of the present invention comprise a cap 1000 configured to be interconnected with a dispensing tip 1100, wherein the dispensing tip 1100 comprises a keyway 1400 which extends from the circumferential groove 1300 toward the first end 1110 of the dispensing tip. The keyway 1400 typically extends between the circumferential groove 1300 and a conical portion 1140 of the dispensing tip, but embodiments described herein are not limited thereto.

The keyway 1400 provides a portion having a radius 1410 which does not exceed the internal radius 1310 of the circumferential groove. The cap 1000 comprises a first end 1010 and a second end 1020, and further comprises a hollow form with a wall thickness 1030. The cap has an open end 1040 directed toward the second end 1020 of the cap, and further comprises a key 1500 extending radially inward from an inner surface 1060 of the cap. The key 1500 has a lateral width 1570 less than the lateral width 1470 of the keyway. To interconnect the cap 1000 with the dispensing tip 1100, the cap 1000 is introduced with the second end 1020 of the cap toward the first end 1110 of the dispensing tip with a longitudinal axis 1050 of the cap aligned with a longitudinal axis 1150 of the dispensing tip, and with the key 1500 radially aligned with the keyway 1400. When the cap 1000 is fully seated on the dispensing tip 1100, rotating the key 1500 to misalign the key 1500 from the keyway 1400 results in the cap 1000 being in a locked configuration 2000 with the key 1500 engaged and captive within the circumferential groove 1300. In order to disconnect the cap 1000 from the dispensing tip 1100, the cap 1000 must be put into an unlocked configuration 2100 which is done by rotating 3000 the cap 1000 about the longitudinal axis 1050 to align the key 1500 with the keyway 1400. The cap 1000 can then be pulled 3100 axially from the dispensing tip 1100.

It will be appreciated that in certain embodiments comprising a cap 1000 configured to interconnect with a dispensing tip 1100, a key 1500 is not required to align with the keyway 1400 as the cap is configured to elastically deform as the dispensing tip 1100 is inserted into the cap 1000. As the dispensing tip 1100 comprises a tapered form, the cap 1000 undergoes elastic or semi-elastic deformation as it is gradually expanded cap is advanced along the tapered form 1140 of the dispensing tip. When the key 1500 engages with the circumferential groove 1300, the cap 1000 snaps back into its original form thereby locking 2000 the cap to the dispensing tip 1100.

Certain embodiments, as shown for instance in FIG. 2A-FIG. 4C, comprise a dispensing tip having a first mechanical stop 1430 on a first lateral side of the keyway 1400, and a second mechanical stop 1430' on a second lateral side of the keyway 1400. The mechanical stops 1430 extend toward the second end 1120 of the dispensing tip and partially into the circumferential 1300 groove, thus providing a mechanical stop 1430 preventing the key 1500 from aligning with the keyway 1400 when rotated 3000, thereby placing the cap in a locked 2000 configuration. A user is unable to remove the cap 1000 from the dispensing tip 1100 until the cap is in an unlocked configuration 2100 which is accomplished by aligning the key 1500 with the keyway when the appropriate motions are performed to the cap. These motions, for instance, include depressing 3200 the cap toward the second end 1120 of the dispensing tip, rotating 3000 the cap 1000 while continuing to depress 3200 and aligning the key 1500 with the keyway 1400, prior to pulling 3100 the cap. Depressing the cap 1000 towards the second end 1120 of the dispensing tip results in the longitudinal translation of the key 1500 toward the second end 1120 of the dispensing tip.

Figure 4A:
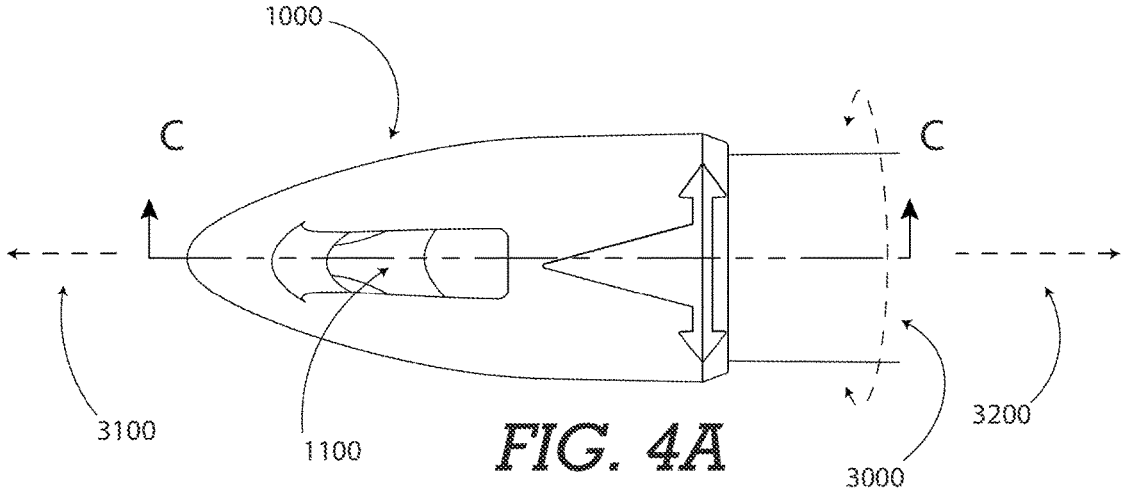
Figure 4B:
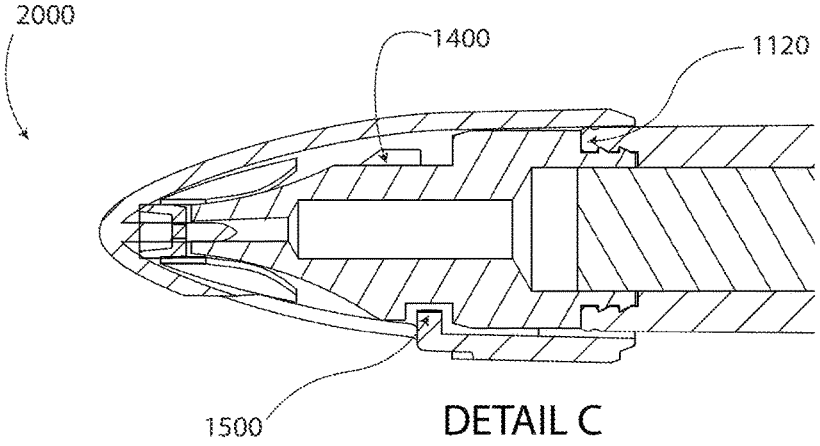
Figure 4C:
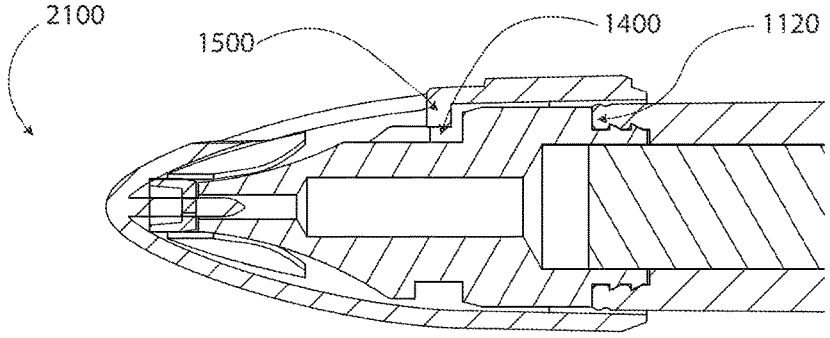
Figure 5A:
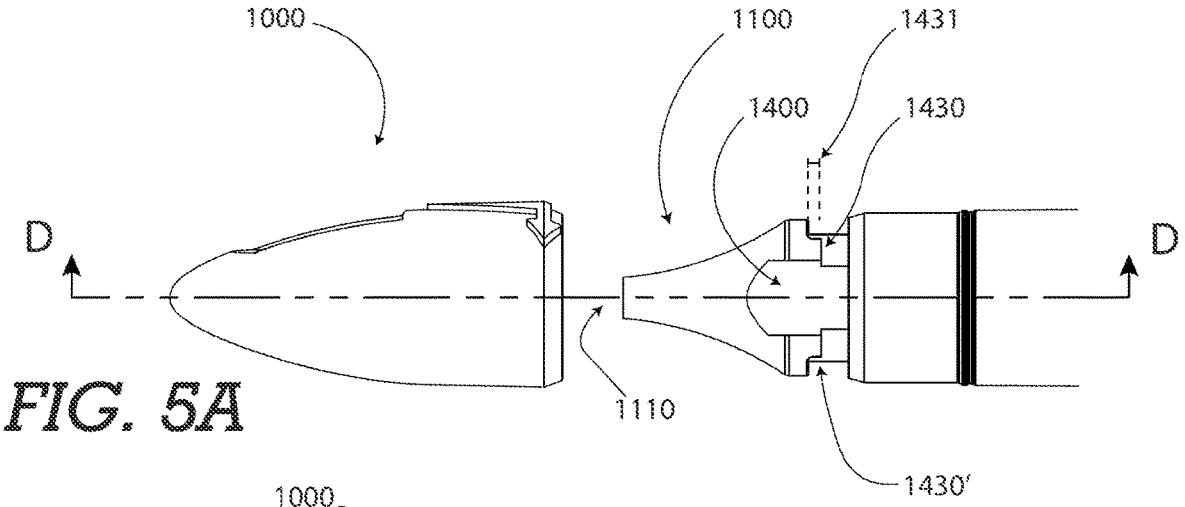
Figure 5B:
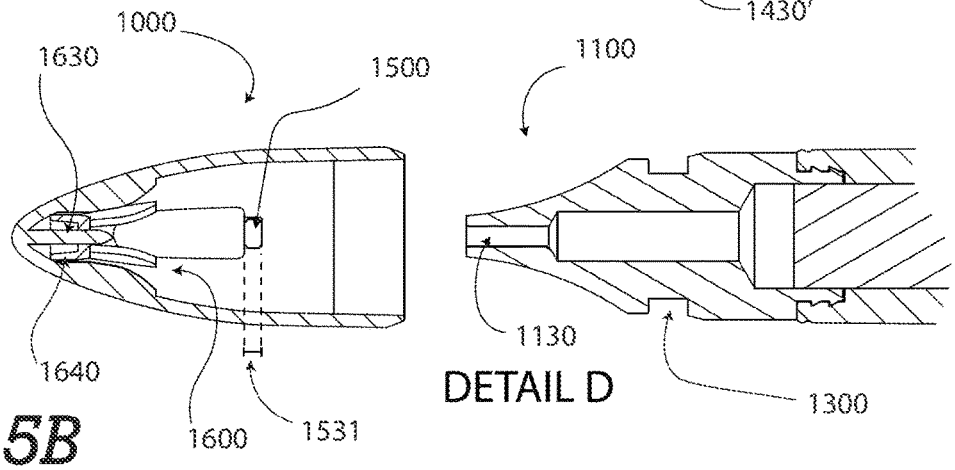
Figure 5C:
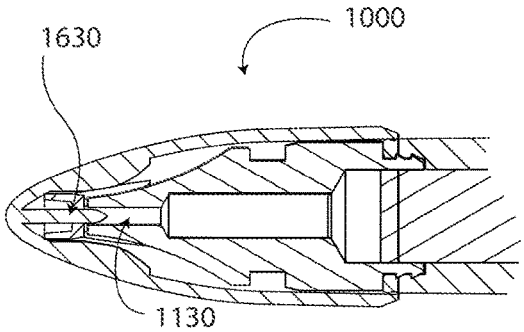
Figure 5D:
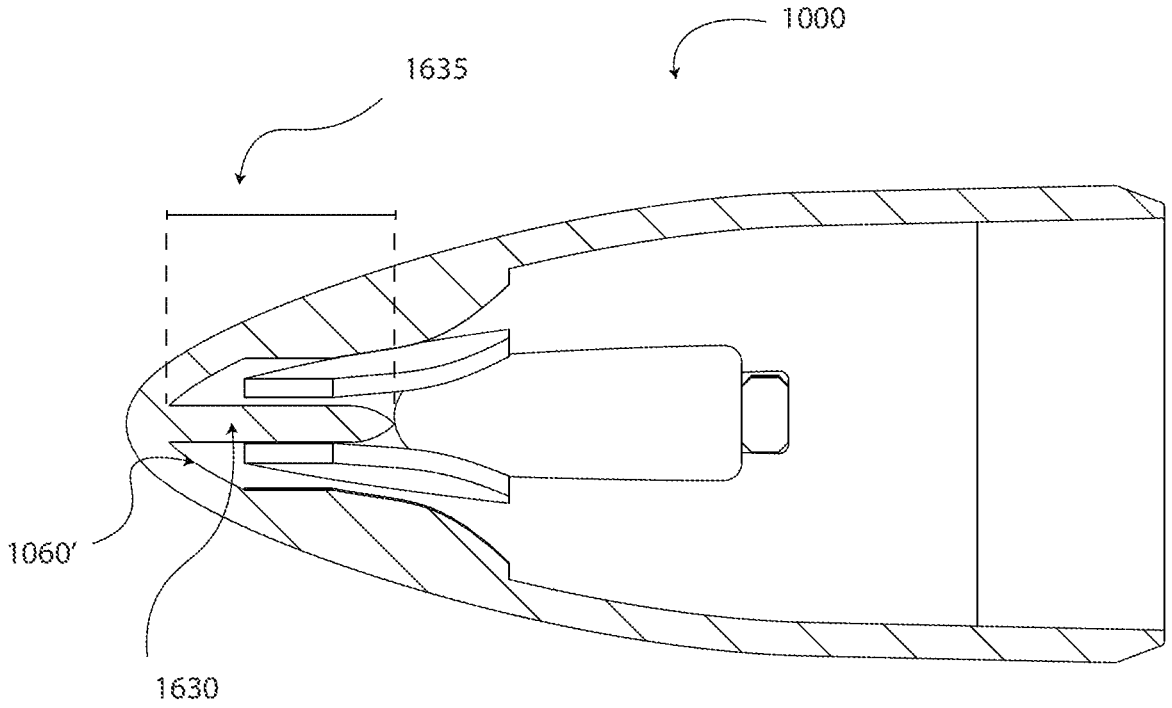
Figures 6A, 6B:
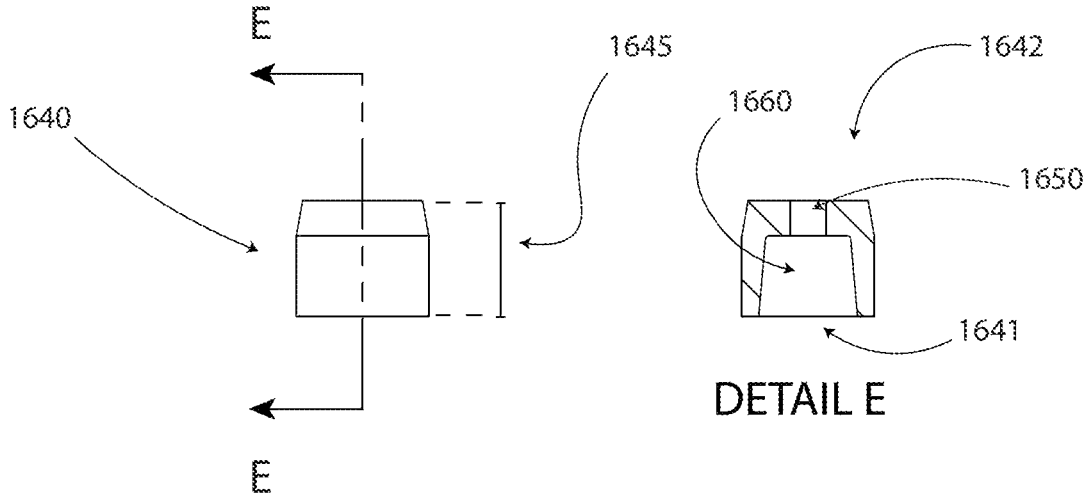
Figure 7:
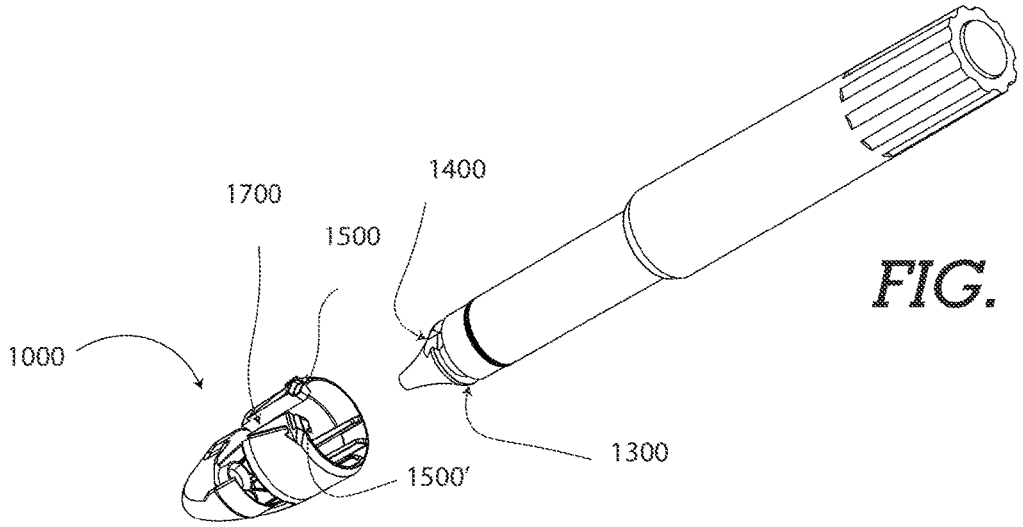
Figure 8A:
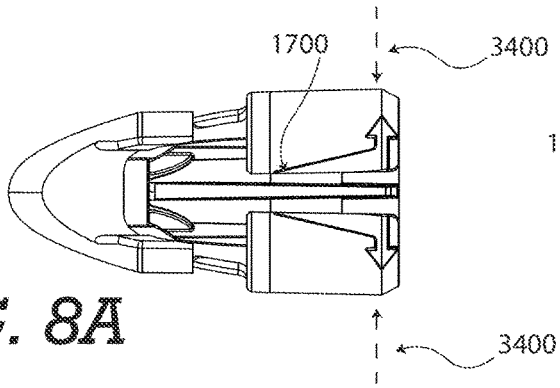
Figure 8B:
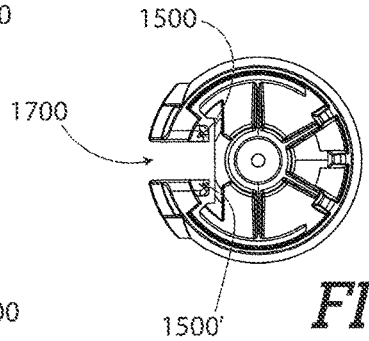
Figure 8C:
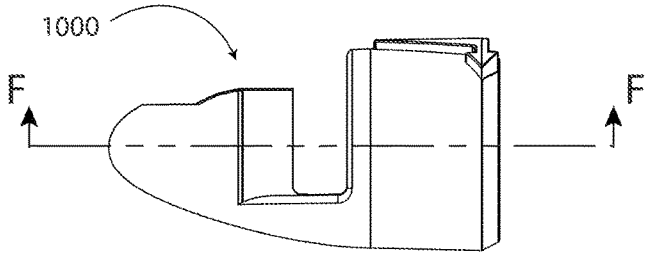
Figure 8D:
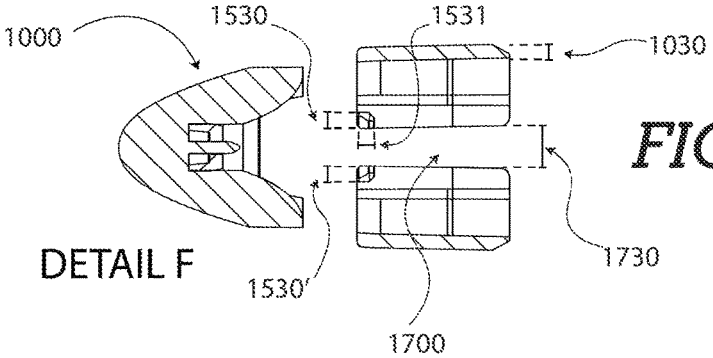

In certain embodiments the sum of the longitudinal width 1531 (FIG. 5B & FIG. 8D) of the key and the longitudinal width 1431 (FIG. 5A) of the mechanical stop 1430 is equal to or less than the width 1320 (FIG. 2A) of the circumferential groove 1300. Accordingly, translating the key 1500 toward the second end 1120 of the dispensing tip allows key 1500 to rotatively traverse past the mechanical stop 1430, thus allowing the rotation of the cap 1000 resulting in the alignment of the key 1500 with the keyway 1400, and thus placing the cap in an unlocked configuration 2100 (FIG. 4C).

In certain embodiments, as shown in FIG. 5A-FIG. 5D, the hollow form of the cap 1000 comprises a recess 1600 configured to receive the first end 1110 of the dispensing tip. A protuberance 1630 having a longitudinal length 1635 extends from an inner surface 1060' of the cap within the recess 1600 toward the second end 1020 of the cap, wherein the protuberance 1630 is configured to insert within the aperture 1130 in the first end 1110 of the dispensing tip when the cap 1000 is interconnected with the dispensing tip 1100. The protuberance 1630 is configured to block the passage of fluid through the aperture 1130 of the dispensing tip when the cap 1000 is interconnected with the dispensing tip 1100.

Certain embodiments comprising a cap 1000, for instance as shown in FIG. 4A-FIG. 6B, further comprise an insert 1640 having a longitudinal length 1645 less than the longitudinal length 1635 of the protuberance. The insert 1640 further comprises an aperture 1650 extending longitudinally therethrough wherein the aperture 1650 of the insert is configured to receive the protuberance 1630. The insert 1640 is configured to be deformed toward the first end 1010 of the cap when the cap is interconnected with the dispensing tip 1100. The insert 1640 of certain embodiments comprises a polymeric material having elastic or semi-elastic properties. In certain embodiments, the insert 1640 is comprised of a food-grade silicone. While embodiments described herein comprising an insert 1640 also comprise a protuberance 1630, it will be appreciated that embodiments comprising an insert 1640 without the presence of an aperture 1650 therethrough or a protuberance 1630 are within the spirit and scope of the present invention.

The insert 1640 of certain embodiments comprises a hollow form with a first end 1641 having an open end 1660 configured to be directed toward the first end 1010 of the cap, and an aperture 1650 in the second end 1642 of the insert. The aperture 1650 of the insert is configured to receive the protuberance 1630 therethrough and create a seal between the aperture 1650 of the insert and the protuberance 1630 when the insert is interconnected with the protuberance. The hollow form further permits the elastic deformation of the insert 1640 wherein the insert is configured to create a seal against the dispensing tip when the cap is interconnected with the dispensing tip.

Certain embodiments of the present invention comprise a dispensing tip 1100 having a circumferential groove 1300 with mechanical stops 1430 and a cap 1000 having an insert 1640. The insert 1640 is configured to deform when the cap is interconnected with the dispensing tip. The deformation of the insert 1640 acts as a spring element and provides a compressive spring-like action in certain embodiments. To remove a cap 1000 which is interconnected with a dispensing tip 1100 in a locked configuration 2000, the cap 1000 is depressed 3200 toward the dispensing tip 1100 thereby deforming the insert 1640 and translating the key 1500 toward the second end 1120 of the dispensing tip whereby the key 1500 is able to laterally traverse past the mechanical stops 1430 to allow the alignment of the key 1500 with the keyway 1400. The alignment of the key 1500 with the keyway 1400 places the cap 1000 in an unlocked 2100 configuration and allows the cap to be pulled 3100 from the dispensing tip.

Certain embodiments of the present invention, such as shown in FIG. 1B and FIG. 7-FIG. 8D, comprises a cap 1000 having a first key 1500 offset from a second key 1500', wherein the keys 1500 extend radially inward from an inner surface 1060 of the cap. The first key 1500 comprises a lateral width 1530, and the second key 1500' comprises a lateral width 1530' equal to the lateral width of the first key. Although embodiments presented herein disclose the keys 1500 having lateral widths 1530 equal to each other, it will be appreciated that alternate embodiments having keys of dissimilar lateral widths is within the spirit and scope of the present invention. The cap 1000 further comprises a longitudinal split 1700 having a lateral width 1730, which extends through the wall thickness 1030 of the cap and extends from between the keys 1500 toward the second end 1020 of the cap. The longitudinal split allows the constriction of the cap, particularly proximal to the keys 1500, thereby reducing the lateral width 1730 of the longitudinal split. The lateral width 1730 of the longitudinal split is configured such that the sum of the lateral width 1730 of the longitudinal split and the lateral width 1530 of the keys is equal to or greater than the lateral width 1470 of the keyway. The keys 1500 prevent the disconnection of the cap from the dispensing tip, which indicates a locked configuration. In order to place the cap 1000 in an unlocked configuration 2100 and disconnect the cap 1000 from the dispensing tip 1100, the cap is squeezed 3400 from the sides of cap, proximal to the keys 1500 to converge the first key 1500 toward the second key 1500' thereby decreasing the lateral width 1730 of the longitudinal split, such that the sum of the lateral width 1530 of the keys and the lateral width 1730 of the longitudinal split is less than the lateral width of the keyway 1470, and the cap 1000 is then rotated 3000 to align the keys 1500 with the keyway 1400 prior to pulling 3100 the cap axially away from the dispensing tip.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A child-resistant cap system comprising:

a dispensing tip adapted for dispensing a fluid, the dispensing tip comprising a dispensing aperture located at a first end of the dispensing tip;

a circumferential groove in an outer surface of the dispensing tip, the circumferential groove is offset from the first end of the dispensing tip toward a second end of the dispensing tip;

the dispensing tip further comprising a keyway extending longitudinally from the circumferential groove toward the first end of the dispensing tip, the keyway comprises a lateral width;

a cap comprising a first end and an open second end, wherein the cap has a hollow form configured to receive the first end of the dispensing tip therein through the second end of the cap;

the cap further comprises a first key, and a second key, each of the keys extending radially inward from an inner surface of the cap, the keys each comprising a lateral width, wherein the lateral width of the first key is equal to the lateral width of the second key, and wherein a sum of the lateral width of the first key and the lateral width of the second key is less than the lateral width of the keyway; and the cap further comprising a longitudinal split extending from the second end of the cap toward the first end of the cap, wherein the longitudinal split extends between the keys, wherein in a locked configuration, the dispensing tip is disposed within the hollow form of the cap, the keys of the cap are engaged with the circumferential groove, and the first key of the cap is misaligned with the keyway of the dispensing tip.

2. The child-resistant cap system of claim 1, further comprising a first mechanical stop on a first lateral side of the keyway and a second mechanical stop on a second lateral side of the keyway, wherein the mechanical stops have a longitudinal width extending longitudinally toward the second end of the dispensing tip and across a portion of a width of the circumferential groove.

3. The child-resistant cap system of claim 2, wherein, the first key of the cap comprises a longitudinal width; and the circumferential groove comprises a width, wherein the sum of the longitudinal width of the mechanical stop and the longitudinal width of the first key, is less than or equal to the width of the circumferential groove.

4. The child-resistant cap system of claim 2, wherein the cap comprises a deformable insert within the hollow form of the cap; and the deformable insert is interconnected with the cap proximal to the first end of the cap.

5. The child-resistant cap system of claim 4, wherein the cap is placed in an unlocked configuration when:

the cap is depressed toward the second end of the dispensing tip resulting in compression of the deformable insert, thereby translating the first key longitudinally toward the second end of the dispensing tip; and the cap is rotated in relation to the dispensing tip to align the first key with the keyway, therein placing the cap in an unlocked configuration, wherein the cap is then configured to be pulled axially away from the dispensing tip to remove the cap from the dispensing tip.

6. The child-resistant cap system of claim 5, wherein the deformable insert comprises a spring.

7. The child-resistant cap system of claim 5, wherein the deformable insert comprises an elastic polymeric material.

8. The child-resistant cap system of claim 7, wherein the deformable insert comprises silicone.

9. The child-resistant cap system of claim 5, further comprising:

a recess within the hollow form of the cap proximal to the first end of the cap, wherein the recess is configured to receive the first end of the dispensing tip;

a protuberance extending away from an inner surface of the recess by a longitudinal length, wherein the protuberance is configured to insert into the dispensing aperture of the dispensing tip in a locked configuration; and the deformable insert further comprises an aperture extending longitudinally therethrough, and the deformable insert comprises a longitudinal length, wherein the protuberance is configured to be inserted through the aperture of the deformable insert, and wherein the longitudinal length of the protuberance is greater than the longitudinal length of the deformable insert.

10. The child-resistant cap system of claim 9, wherein the sum of the lateral width of the longitudinal split, the lateral width of the first key, and the lateral width of the second key, is greater than the lateral width of the keyway in the locked configuration.

11. The child-resistant cap system of claim 10, wherein the longitudinal split is configured to allow constriction of the second end of the cap, resulting in decreasing the lateral width of the longitudinal split, which results in the first key converging toward the second key.

12. The child-resistant cap system of claim 11, wherein the cap is placed in an unlocked configuration when:

the second end of the cap is constricted, thereby reducing the lateral width of the longitudinal split until the sum of the lateral width of the longitudinal split, the lateral width of the first key, and the lateral width of the second key, is less than the lateral width of the keyway; and the cap is rotated in relation to the dispensing tip to align the first key and the second key with the keyway, therein placing the cap in an unlocked configuration, wherein the cap is then configured to be pulled axially away from the dispensing tip to remove the cap from the dispensing tip.

13. The child-resistant cap system of claim 12, further comprising:

a protuberance extending away from an inner surface of the recess by a longitudinal length, wherein the protuberance is configured to insert into the dispensing aperture of the dispensing tip in a locked configuration.

14. A child-resistant cap system comprising:

a dispensing tip having a longitudinal axis coinciding with a dispensing aperture, the dispensing aperture located at a first end of the dispensing tip;

a circumferential groove in an outer surface of the dispensing tip offset from the first end of the dispensing tip toward a second end of the dispensing tip;

a cap comprising a first end and a second end, wherein the cap has a hollow form with a wall thickness, and an open end directed toward the second end of the cap;

the cap further comprises a longitudinal axis, wherein the longitudinal axis of the cap and the longitudinal axis of the dispensing tip are configured to align when the cap is interconnected with the dispensing tip and the second end of the cap is advanced toward the first end of the dispensing tip;

the hollow form of the cap comprising a recess configured to receive the first end of the dispensing tip, and a protuberance of a longitudinal length extending from the recess toward the second end of the cap, wherein the protuberance is configured to insert within an opening in the second end of the dispensing tip when the cap is interconnected with the dispensing tip;

an insert having a longitudinal length less than the longitudinal length of the protuberance, the insert having a hollow form with an open end directed toward the first end of the cap and an aperture in the second end of the insert, wherein the aperture is configured to receive the protuberance therethrough;

a first key and a second key interconnected with the cap, the keys each extending radially inward from an inner surface of the cap, the first key comprising a lateral width equal to a lateral width of the second key;

a longitudinal split through the cap extending longitudinally from between the keys toward the second end of the cap, and the longitudinal split having a lateral width, wherein the longitudinal split extends through the wall thickness of the cap; and a keyway interconnected with the dispensing tip, extending longitudinally from the circumferential groove toward the first end of the dispensing tip, wherein a lateral width of the keyway is greater than the lateral width of the first key, less than a first distance between the first key and the second key, and greater than a sum of the lateral width of the first key and the lateral width of the second key;

a first mechanical stop on a first lateral side of the keyway, and a second mechanical stop on a second lateral side of the keyway, wherein the mechanical stops extend longitudinally toward the second end of the dispensing tip and partially into the circumferential groove, wherein to disconnect the cap from the dispensing tip, the cap is squeezed proximal to the keys to constrict the cap and converge the first key toward the second key such that the sum of the lateral width of the keys and the lateral width of the longitudinal split is less than the lateral width of the keyway, and the cap is depressed toward the second end of the dispensing tip while rotating the cap to align the keys with the keyway, prior to pulling the cap axially away from the dispensing tip.

* * * * *